United States Patent [19]

Brackmann

[11] Patent Number: 4,787,401

[45] Date of Patent: Nov. 29, 1988

[54] SCULPTURED CIGARETTE

[75] Inventor: Warren A. Brackmann, Mississauga, Canada

[73] Assignee: Rothmans of Pall Mall Limited, North York, Canada

[21] Appl. No.: 935,215

[22] Filed: Nov. 26, 1986

[30] Foreign Application Priority Data

Dec. 4, 1985 [GB] United Kingdom ..... 8529851

[51] Int. Cl.[4] ..... A24D 1/00; A24F 1/00; A24C 5/14; A24C 5/39

[52] U.S. Cl. ..... 131/360; 131/364; 131/84.1; 131/84.4

[58] Field of Search ..... 131/364, 360, 84.1, 131/84.2, 84.3, 84.4

[56] References Cited

U.S. PATENT DOCUMENTS 1,829,559 10/1931 Gilliam ..... 131/364
4,459,998 7/1984 Labbe ..... 131/364

*Primary Examiner*—V. Millin
*Attorney, Agent, or Firm*—Sim & McBurney

[57] ABSTRACT

A novel cigarette structure is provided which produces an approximately uniform delivery of flavour along its length as the cigarette is smoked. The filler rod of the cigarette has a strip of more highly-flavoured tobacco to one side or to two sides of the rod, with the remainder of the cross-section of the rod being formed of lower flavoured tobacco, and has a higher proportion of the more highly-flavoured tobacco than the lower flavour tobacco at the lighting end. The cigarette filler rod of improved smoking characteristics may be formed by a simplified assembly procedure.

7 Claims, 2 Drawing Sheets

SCULPTURED CIGARETTE

FIELD OF THE INVENTION

The present invention relates to a novel cigarette structure wherein tobacco in the cigarette is arranged to provide improved smoking characteristics.

BACKGROUND TO THE INVENTION

It is well known, for example, from U.S. Pat. No. 1,829,559, to form cigarettes of two or more different types of smoking materials, wherein one type of smoking material predominates in an inner core while another type of smoking material predominates in an outer annulus totally surrounding and enclosing the core.

It is also well known that a substantial proportion of the tobacco smoke entering a smoker's mouth results from the burning of tobacco in the peripheral regions of the cigarette. It is estimated that about 80% of the volume of smoke entering the smoker's mouth originates from only about 50% of the weight of tobacco in the cigarette.

It is further well known that, when a cigareete is first lit up, smoke from the burning of tobacco material in the whole cross-section of the cigarette is drawn into the smoker's mouth and not predominantly from the buring of annulus material, thereby producing a different taste for the smoker upon lighting up.

In copending U.S. patent application Ser. No. 862,702 filed May 13, 1986, assigned to the assignee hereof and the disclosure of which is incorporated herein by reference, there is described a cigarette in which additional quantities of the annulus material are provided in the lighting end of the cigarette, so that, upon the cigarette being lit, the smoke reaching the mouth of the smoker is derived mainly from annulus material. In this way, little or no change in the taste of the tobacco smoke is perceived by the smoker as the burning proceeds from light up to continued smoking.

In my copending U.S. patent application filed simultaneously herewith entitled "Linear Layered Cigarette", assigned to the assignee hereof and the disclosure of which is incorporated herein by reference, there is described a novel cigarette structure in which two outer strips or layers of higher flavour/tar ratio shredded tobacco lamina material sandwich an intermediate layer of lower flavour/tar ratio shredded lamina material at the same or similar tar level, which enables overall manipulation of flavour and tar in a cigarette to be effected.

As described therein, in one procedure, highly flavoured tobacco is trimmed from one side of the cigarette and is recirculated in the cigarette-making machine to provide the tobacco layer on the opposite side of the rod. Dense ending techniques may be employed to provide an increased quantity of the highly-flavoured tobacco at the end of the cigarette.

Conventional dense ending techniques include the use of a rotary cutter for trimming which has a pocket or notch in it so as to trim a lesser thickness of tobacco as the cigarette end segment of the rod passes the trimmer. Instead of varying the height of the tobacco trimming location, the tobacco segment just prior to the trimming point may be compressed, for example, with a rotary compression device having lobes which mechanically compress the tobacco towards the rod-carrying surface.

SUMMARY OF THE INVENTION

In accordance with the present invention, there is provided a novel cigarette formed from two different blends of tobacco and having an approximately uniform delivery of flavour along its length as the cigarette is smoked. In addition, the present invention provides a simplified method of assembly of a cigarette filler rod comprising differing blends of tobacco.

In accordance with the present invention, in an existing cigarette making machine, a first blend of shredded lamina having a first flavour/tar ratio is placed in the left hand side of the hopper, or the side of the hopper which provides the tobacco closest to the rod-forming and -conveying surface, while a second blend of shredded lamina having a higher flavour/tar ratio is placed in the right hand side of the hopper, or the side of the hopper which provides the tobacco on the opposite side of the rod from the rod-forming surface. The hopper then forms a shower of tobacco particles and a filler rod is formed from the shower by passing the rod-forming and -conveying surface transverse to the shower. The higher flavoured tobacco is trimmed from the filler rod and the trimmed tobacco is returned to the left hand side of the hopper to form part of that blend. A dense end device is used to increase the quantity of the higher flavoured tobacco in the end of the cigarette.

The cigarette that results has an increased quantity of highly-flavoured tobacco in the end and a concentration of highly-flavoured tobacco to one side. The increased quantity of highly-flavoured tobacco in the lighting end increases the initial flavour impact to the smoke, while the strip of highly-flavoured tobacco to the side increases the overall flavour without increasing the level of tar in the smoke to the same extent. The effect also permits tar to be reduced but at a lesser sacrifice of flavour.

GENERAL DESCRIPTION OF INVENTION

Figure 1:
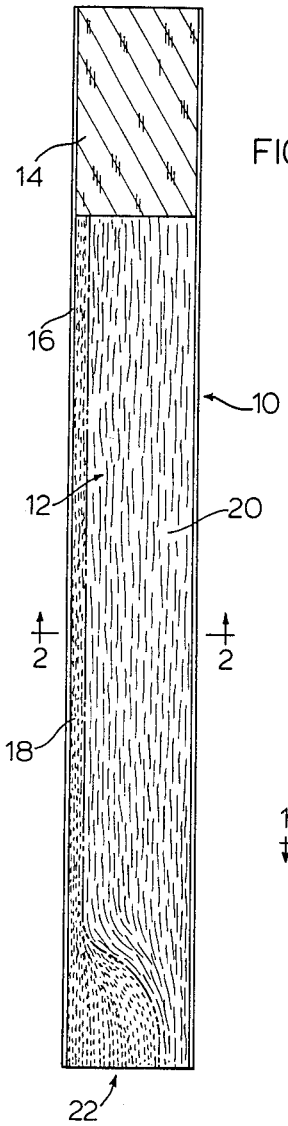
FIG. 1 is a longitudinal sectional view of a novel cigarette provided in accordance with one embodiment of the invention, taken along line 1—1 of FIG. 2.

One significant advantage of the cigarette of the invention is that is can be produced on existing cigarette-making equipment without any hardware change and the only difference being the necessity to feed two tobacco blends to the hopper in place of one, and yet there can be produced a cigarette having significantly improved smoking characteristics.

To increase the desirable effect of the dense end of highly-flavoured tobacco, and to further enhance the uniformity of smoking characteristics, the length of the dense end may be increased, for example, by increasing the peripheral length of the notch in the trimming wheels.

During the smoking of a cigarette, the quantity of flavour components in the smoke tends to increase as the cigarette is smoked, so that the last puffs usually contain approximately three times the amount of flavour components than the first puff. It is possible to vary the cross-sectional relative proportions of tobacco in the layers in the filler rod along the length of the cigarette, so as to provide a more uniform distribution of smoking characteristics along the length of the cigarette.

The cigarette sculpturing techniques described herein may also be combined with the linear layering techniques described in my aforementioned U.S. patent application Ser. No. 862,702. In such a combination, both sides of the cigarette may be trimmed to provide complimentarily-arranged sides of the cigarette.

In the present invention, the filler rod can be further modified to provide a more uniform distribution of the flavour component. In the dense end device noted above wherein lobes are employed to mechanically compress the tobacco against the tape, the lobes conveniently can be shaped in order to vary the amount of tobacco trimmed as the filler rod moves past the cutter. In this way, the quantity of the highly-flavoured tobacco can be shaped as a function of distance along the finished cigarette, and thereby the quantity of highly-flavoured tobacco along the length of the cigarette is controlled.

By controlling the quantity of highly-flavoured tobacco across the cross-section of the cigarette rod in each portion but not all portions necessarily of the length of the cigarette, it is possible to provide a more uniform flavour to smoke drawn from the cigarette by the smoker along the length of the cigarette. At the same time, since the provision of the separate blend of highly-flavoured tobacco located to one side of the filler rod permits flavour and tar characteristics of the smoke to be modified, considerable versatility is provided with respect to the overall smoking characteristics of the cigarette.

The provision of tobacco lamina blends with differing flavour-to-tar ratios can be achieved by selecting tobacco from different parts of a tobacco plant. Generally, leaves from the upper part of the tobacco plant have a higher flavour/tar ratio than leaves from the lower part of the tobacco plant. In blending the tobacco for inclusion in the cigarette, the higher flavour/tar ratio tobacco normally included in the blend is maintained as a separate blend, although some of such higher flavoured tobacco is present in the lower flavour/tar ratio blend by the recycle of trimmed tobacco, as described above.

DESCRIPTION OF PREFERRED EMBODIMENT

Figure 2:
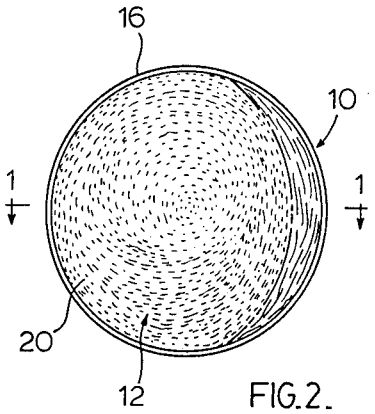
FIG. 2 is a cross-sectional view of the cigarette of FIG. 1, taken along line 2—2 of FIG. 1.

Referring to the drawings, FIGS. 1 and 2 illustrate schematically a novel cigarette 10 comprising a tobacco filter rod 12 and a filter 14 at the smoking end. The filter rod 12 is enclosed within a paper tube 16.

The tobacco filter rod 12 comprises a first portion 18 of higher flavour/tar ratio tobacco lamina located at one side of the rod 12 and a second portion 20 of lower flavour/tar ratio tobacco lamina occupying the remainder of the cross section of the filter rod 12.

At the lighting end 22 of the cigarette 10, the filter rod 12 has a higher proportion of the higher flavour blend tobacco in the cross-section of the filter rod 12. The increases quantity of the more highly flavoured tobacco in the lighting end 22 increases the initial flavour impact to the smoker, while the strip 18 of highly-flavoured tobacco to the one side of the filter rod 12 increases the overall flavour of the cigarette without increasing the level of tar in the smoke to the same extent.

Figure 3:
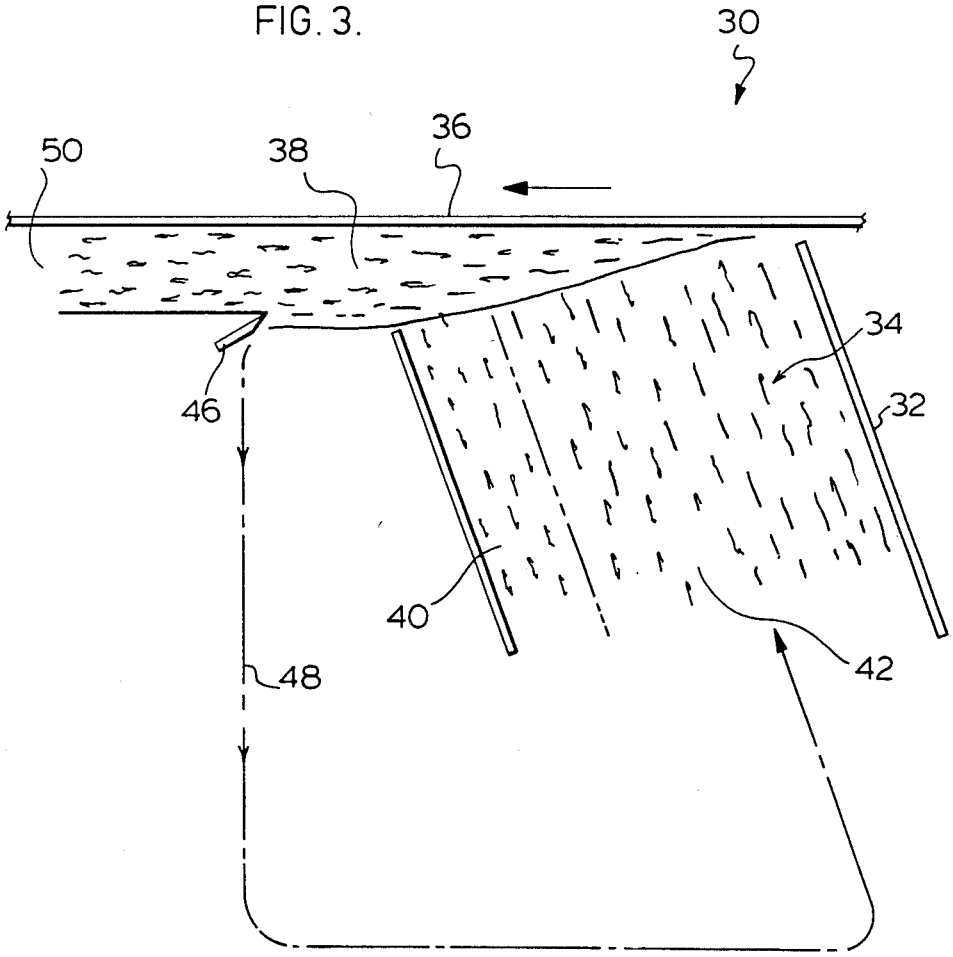
FIG. 3 is a schematic sectional view of a cigarette making machine constructed in accordance with one embodiment of the invention.

Referring now to FIG. 3, there is shown therein permanent cigarette rod forming apparatus 30 having an upwardly extending tobacco shower guide 32 for leading a shower of tobacco particles 34 upwardly against the underside of a transversely moving rod forming belt 36.

As the belt 36 moves laterally with respect to the tobacco shower 34, a filler rod 38 is built up on the undersurface of the belt 36. The shower 34 is comprised by first side portion 40 comprising a blend of shredded tobacco lamina material having a higher flavour/tar ratio than the tobacco in the remainder 42 of the width of the shower 34.

The filler rod 38 is formed with more tobacco than is ultimately required in a cross-section of the rod and the tobacco is trimmed from the rod by a timmer 46. Since the more highly flavoured tobacco is provided in the side portion 40 of the shower 34 and this tobacco is laid down last on the filler rod 38, a layer of the highly flavoured tobacco is provided on the side of the filler rod 31 facing the trimmer 46.

More highly flavoured tobacco which is trimmed from the filler rod by the trimmer 46 is collected and recycled by line 48 to the shower portion 42. In this way, the final trimmed rod 50 has a layer of more highly flavoured tobacco one side of the filler rod.

SUMMARY OF DISCLOSURE

In summary of this disclosure, the present invention provides a novel arrangement of tobacco in a cigarette which enables considerable versatility and uniformity of smoking characteristics to be achieved. The present invention also provides a method of forming such cigarettes by simple yet effective modification of existing cigarette manufacturing operations. Modifications are possible within the scope of this invention.

What I claim is:

1. A novel cigarette having a tobacco filler rod in a paper tube, comprising a first blend of shredded tobacco lamina material having a first flavour/tar ratio in a strip within the cross-section of the rod, a second bland of shreded tobacco lamina material having a higher flavour/tar ratio than said first blend provided in a strip to one side of the cross-section of said rod, and a lighting end having a higher proportion of said higher flavour/-tar ratio tobacco in the cross-section of said rod than in the cross-section of said rod other than at said lighting end.

2. The cigarette of claim 1 wherein a strip of said higher flavour/tar ratio tobacco is provided on both opposite sides of the cross-section of said rod with said first flavour/tar ratio shredded tobacco lamina material therebetween.

3. The cigarette of claim 1 wherein the ratio of said higher flavour/tar ratio tobacco at said lighting end is substantially the same for a predetermined length of said filler rod froms aid lighting end and then decreases gradually over a further predetermined length of said filler rod from said lighting end.

4. The cigarette of claim 1 wherein said lighting end has a greater overall tobacco density than the remainder of the length of the filler rod.

5. The cigarette of claim 1, wherein the cross-sectional relative proportion of the higher flavour/tar ratio tobacco decreases along the length of the cigarette from the lighting end.

6. In a method of forming a cigarette filler rod in which tobacco is fed from a hopper as a shower of tobacco particles which is collected on a tobacco filler rod-forming and -conveying surface, the improvement wherein:

a first blend of shredded tobacco lamina material having a first flavour/tar ratio is located in a first side of the thopper corresponding to the tobacco closest to the filler rod-forming and -conveying surface in the tobacco filler rod, a second blend of shredded lamina material having a higher flavour/tar ration than said first blend is located in a second side of the hopper corresponding to the tobacco farthest from the filler rod-forming and -conveying surface in the tobacco filler rod, higher flavour/tar ratio tobacco is trimmed from said filler rod and said trimmed tobacco is recycled to said first side of said hopper to form part of said first blend, and the quantity of higher flavour/tar ratio tobacco is increased at predetermined locations along the length of the filler rod corresponding to the lighting end of a cigarette formed from said rod.

7. The method of claim 6 wherein the increase in quantity of higher flavour/tar ratio tobacco is effected so as to provide a first portion of the length of the filler rod in which said increased higher flavour/tar ratio tobacco is present in uniform proportion and a second portion in which the proportion gradually decreases.

* * * * *